US007810346B2

(12) United States Patent
Jeong et al.

(10) Patent No.: US 7,810,346 B2
(45) Date of Patent: Oct. 12, 2010

(54) ICEMAKER AND METHOD FOR CONTROLLING THE SAME

(75) Inventors: Kyung Han Jeong, Seoul (KR); In Chul Jeong, Seoul (KR); Nam Gi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 437 days.

(21) Appl. No.: 11/611,340

(22) Filed: Dec. 15, 2006

(65) Prior Publication Data

US 2007/0151282 A1 Jul. 5, 2007

(30) Foreign Application Priority Data

Dec. 16, 2005 (KR) ..... 10-2005-0124880

(51) Int. Cl.
*F25C 5/08* (2006.01)

(52) U.S. Cl. ..... 62/351; 62/353

(58) Field of Classification Search ..... 62/340–356
See application file for complete search history.

(56) References Cited

U.S. PATENT DOCUMENTS

| | | | | |
|---|---|---|---|---|
| 3,662,564 | A | 5/1972 | Clearman et al. | |
| 3,702,543 | A | 11/1972 | Lyman | |
| 3,779,033 | A | 12/1973 | Swanson | |
| 4,756,165 | A * | 7/1988 | Chestnut et al. | 62/135 |
| 5,123,260 | A | 6/1992 | Althoff et al. | |
| 5,582,754 | A * | 12/1996 | Smith et al. | 219/438 |
| 6,112,540 | A * | 9/2000 | Serrels et al. | 62/351 |
| 7,051,541 | B2 | 5/2006 | Chung et al. | |
| 7,111,473 | B2 | 9/2006 | Chung et al. | |
| 2005/0056043 | A1 | 3/2005 | Lee et al. | |
| 2005/0115266 | A1 | 6/2005 | Lim et al. | |
| 2006/0174646 | A1 * | 8/2006 | Comerci et al. | 62/340 |

FOREIGN PATENT DOCUMENTS

| | | |
|---|---|---|
| CN | 1573270 | 2/2005 |
| JP | 2003-279221 | 10/2003 |
| KR | 0107012 | 6/1996 |
| KR | 10-2005 0027357 | 3/2005 |

OTHER PUBLICATIONS

English Language Abstract of corresponding KR 10-1993-0013644.
U.S. Appl. No. 11/554,231 to Jeong et al., which was filed on Oct. 30, 2006.
U.S. Appl. No. 11/385,733 to Chung et al., which was filed on Mar. 22, 2006.
English language Abstract of Korea No. 10-2005-0027357.

* cited by examiner

*Primary Examiner*—William E Tapolcai
(74) *Attorney, Agent, or Firm*—McKenna Long & Aldridge LLP

(57) ABSTRACT

An icemaker and a method for controlling the same are disclosed. An object of the present invention is to provide an icemaker and a method for controlling the same, which has an improved structure to make a lot of ice in a short time. an icemaker includes an ice tray rotatable with at least one column of ice making chambers formed therein to make ice; an ejector rotatably provided in each ice making chamber to eject the ice formed in the ice making chamber; an operation device which rotates the ice tray; and a separation device which separates the ice from the ice tray. The separation device may be a heater which heats the ice. Preferably, the heater is operated until adhesive force which acts between the ice and the ice tray is smaller than pushing force in which the ejector pushes the ice.

11 Claims, 17 Drawing Sheets

ICEMAKER AND METHOD FOR CONTROLLING THE SAME

This application claims the benefit of the Patent Korean Application No. 10-2005-0124880, filed on Dec. 16, 2005, which are hereby incorporated by reference as if fully set forth herein.

BACKGROUND OF THE INVENTION

1. Field of the Invention

The present invention relates to an icemaker, more particularly, to an icemaker having a simple structure, which can eject ice from an ice tray with less energy, and a method for controlling the same.

2. Discussion of the Related Art

In general, a household refrigerator/freezer has a freezing chamber and a refrigerating chamber. The refrigerating chamber keeps its temperature at 3~4 degree. C to preserve food and various vegetables fresh. The freezing chamber keeps its temperature at a sub-zero, which is below 0 degree. C, to preserve frozen meat and frozen food.

Recently, a household refrigerator is sold with various functions including an icemaker which automatically make ice without a consumer's additional operations and a dispenser which a user can use ice and water outside of the refrigerator, which are great conveniences to the consumer. FIGS. 1 and 2 illustrate an icemaker for a conventional refrigerator. Referring to FIGS. 1 and 2, the icemaker will be described in detail.

The conventional icemaker 10 includes an ice tray 11, a water-supplying part 12, a heater 17, an ejector 14, an operating device 13, an ice bank 20 and over fill detection mechanism 15. The ice tray 11 has an ice making chamber. The water supplying part 12 is formed a side of the ice tray 11 to supply water to the ice making chamber. The heater 17 is mounted on a lower surface of the ice tray 11. The ejector 14 ejects the ice made in the ice tray 11. The operating device 13 drives the ejector 14. The ice bank 20 receives and stores the ice from the ice tray 11. And, the over fill detection mechanism 15 detects the amount of ice filled in the ice bank 20.

The water supplying part 12 is connected to an external water supply source (not shown) provided outside of the refrigerator to supply water into the ice tray 11 when ice making is requested. The ice tray 11 has an approximate semi-cylindrical shape and partition plates are provided in the ice tray 11 to partition the ice making chamber into plural units so that plural ices having predetermined sizes may be made.

As shown in FIG. 2, the heater 17 is mounted on a lower surface of the ice tray 11 to heat the ice tray 11 so that the ice may be melted enough to be ejected from the ice tray 11 smoothly.

The ejector 14 includes a rotational shaft crossing a center of the ice tray 11 and plural ejector fins 14*a* perpendicularly projected from the rotational shaft. Each ejector fin 14*a* is corresponding to each unit partitioned by the partition plates to eject each ice within the each unit as the ejector fins 14*a* is rotating.

A slide 16 is downwardly inclined in a portion of the ice tray 11 where ices are ejected to a portion adjacent to the rotational shaft of the ejector 14. Thus, the ice ejected from the ice tray 11 is sliding on the slide 16 and stored in the ice bank 20 provided below the icemaker 10.

The over fill detection mechanism 15 is moved upwardly/downwardly by the operation device 13 to check the amount of ice filled in the ice bank 20. If the ice bank 20 is filled with ice, the over fill detection mechanism 15 may not move downwardly enough, such that it is detected whether the ice bank 20 is filled.

However, the conventional icemaker for a refrigerator should have the heater, the ejector and the ejector operation device for the ejector. Also, the over fill detection mechanism and its operation device are needed. Thereby, the configuration of the conventional icemaker may be complicated and production cost thereof will be high.

Moreover, the over fill detection mechanism of the conventional icemaker should be rotational to detect whether the ice bank is filled. Thus, large space should be secured near the ice tray for the rotation of the over fill detection mechanism and the ice tray cannot but be fabricated relatively small. It causes a problem that many ices cannot be made in a short time.

Still further, the conventional icemaker should fully heat the ice tray before ejecting the ice. That is because ice can be ejected from the ice tray without any break of ice. Thus, since the heater should be heated for a long time, too much energy is consumed. Also, since the ice may be melted too much, water may be splashed together with ice when the ice is ejected by the ejector. The splashed water may flow into the ice bank enough to make ice stuck together. Thereby, there may be a problem that the ice within the ice bank may not be automatically discharged into the dispenser of the refrigerator.

SUMMARY OF THE INVENTION

Accordingly, the present invention is directed to an icemaker and a method for controlling the same that substantially obviates one or more problems due to limitations and disadvantages of the related art.

An object of the present invention is to provide an icemaker and a method for controlling the same, which has an improved structure to make a lot of ice in a short time.

Another object of the present invention is to provide an icemaker and a method for controlling the same, which can minimize melting amount of ice needed in the ice ejecting to efficiently prevent dropping water from an ice making chamber when ejecting the ice.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an icemaker includes an ice tray rotatable with at least one column of ice making chambers formed therein to make ice; an ejector rotatably provided in each ice making chamber to eject the ice formed in the ice making chamber; an operation device which rotates the ice tray; and a separation device which separates the ice from the ice tray.

The separation device may be a heater which heats the ice. Preferably, the heater is operated until adhesive force which acts between the ice and the ice tray is smaller than pushing force in which the ejector pushes the ice.

Alternatively, the heater may apply high energy to a boundary portion between the ice and the ice tray to melt at least some boundary portion where the ice is stuck to the ice tray, so that the ice is prevented from being melted enough to drop water when the ice tray rotates.

The ejector may include a shaft rotatable along a longitudinal direction of the ice making chamber; an ejector fin projected on the shaft each predetermined distance to eject the ice of the ice tray; and an ejector operation part which rotates the ejector by using rotation force of the operation device.

The ejector operation part may include a driving gear which rotates according to the rotation of the operation device; and a driven gear provided in the ejector to be engaged to the driving gear.

The ejector may include a shaft rotatable along a longitudinal direction of the ice tray; an ejector fin projected on the shaft each predetermined distance to eject the ice of the ice tray as the shaft rotates; and an inertial operation part which generates rotational force due to its weight when the ice tray rotates, to relative-rotate the shaft with respect to the ice tray.

Preferably, the inertial operation part includes a weight; and an arm having an end connected to an end of the shaft and the other end connected to the weight.

Also, the ejector further may include a sensor which senses whether the ejector rotates.

In another aspect of an icemaker may include an ice tray rotatable with at least one column of ice making chambers formed therein to make ice; an ejector rotatably provided in each ice tray to eject the ice made in the ice making chamber; an operation device which rotates the ice tray; and a separation device which separates the ice from the ice tray.

Preferably, the separation device is a heater which heats the ice and the heater is operated until adhesive force which acts between the ice and the ice tray is smaller than pushing force in which the ejector pushes the ice.

Preferably, the heater applies high energy to a boundary portion between the ice and the ice tray to melt at least some boundary portion where the ice is stuck to the ice tray, so that the ice is prevented from being melted enough to drop water when the ice tray rotates.

Alternatively, the ejector may include a shaft fixed to an upper portion a predetermined distance from the ice tray along a longitudinal direction of the ice tray; and an ejector fin projected toward the ice making chamber from the shaft each predetermined distance to push the ice of the ice making chamber as the ice tray rotates.

In still another aspect of the present invention, a first embodiment of a method for controlling an icemaker includes steps of: making ice in an ice making chamber formed in an ice tray; determining whether making ice is completed; separating the ice from the ice making chamber; ejecting the ice outside of the ice making chamber; and returning the ice tray and the ejector to their original positions.

Preferably, the step of ejecting the ice outside of the ice making chamber is a step of rotating the ice tray and the ejector.

Alternatively, the step of ejecting the ice outside of the ice making chamber may be a step of rotating the ice tray.

Preferably, the ice is heated by a heater in the step of separating the ice from the ice making chamber.

A second embodiment of a method for controlling an icemaker includes steps of: making ice in an ice making chamber formed in an ice tray; determining whether the ice making is completed; rotating the ice tray; separating the ice from the ice making chamber; ejecting the separated ice outside of the ice making chamber; determining whether the ejecting of the ice is completed; and returning the ice tray and the ejector to their original positions.

Whether the ice is completely ejected may be determined by whether the ejector rotates.

Preferably, the step of separating the ice from the ice making chamber is stopped if it is determined that the ice is completely ejected in the step of determining whether the ejecting of the ice is completed.

The ice is heated by a heater in the step of separating the ice from the ice making chamber.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
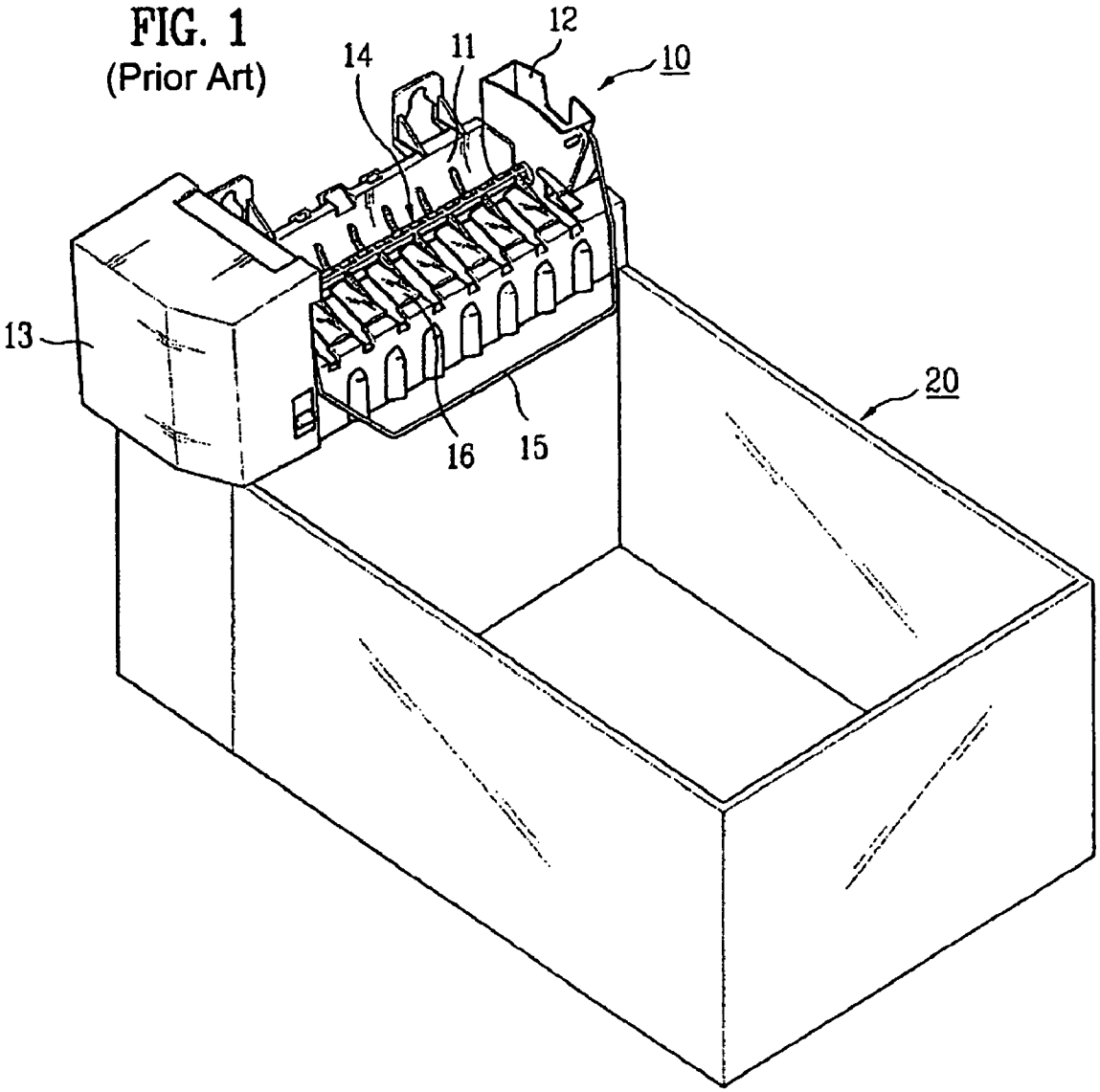
FIG. 1 (Prior Art)
FIG. 1 is a perspective view illustrating a conventional icemaker of the prior art.
Figure 2:
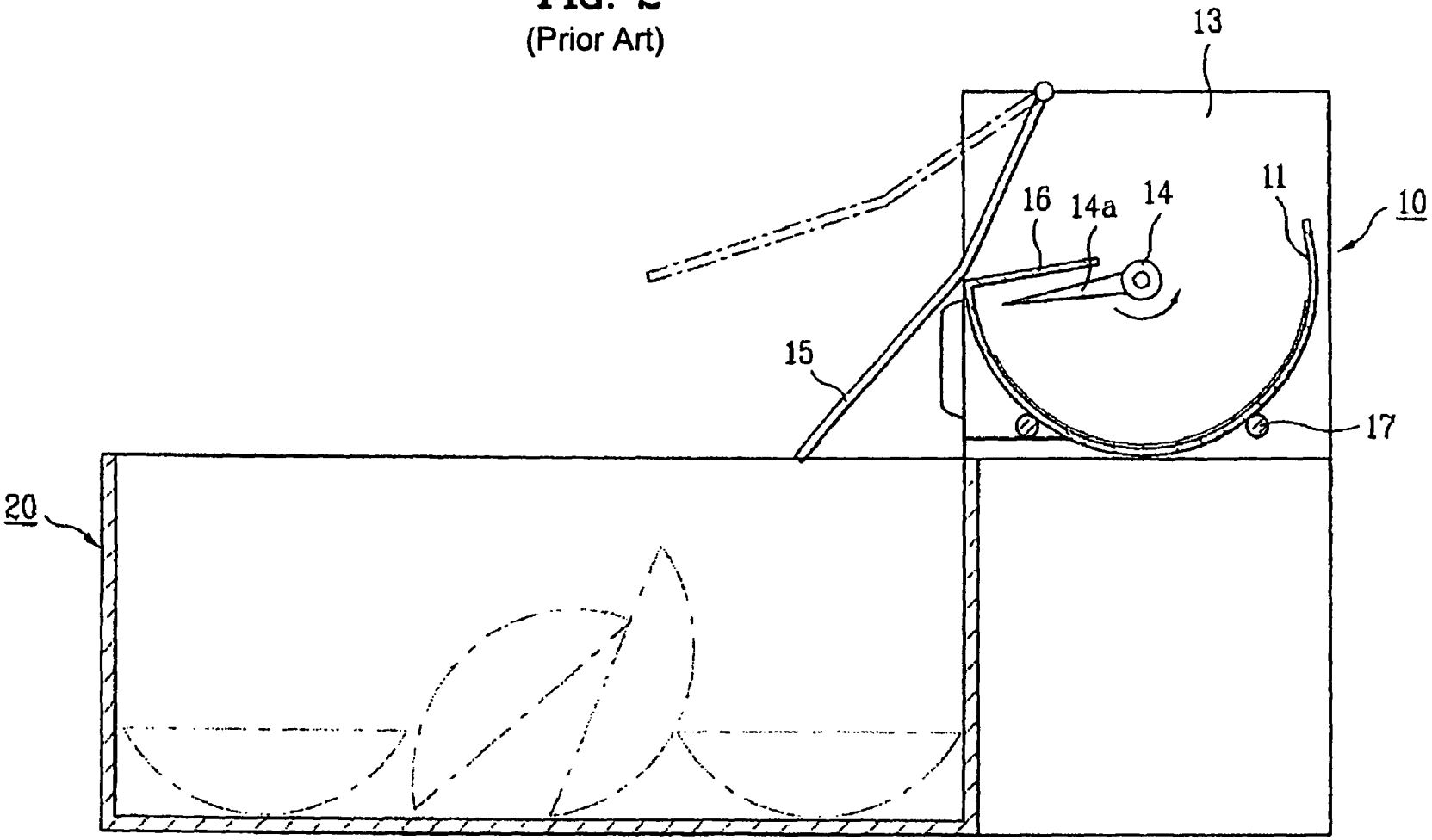
FIG. 2 (Prior Art)
FIG. 2 is a sectional view illustrating an operation of the ice maker shown in FIG. 1.
Figure 3:
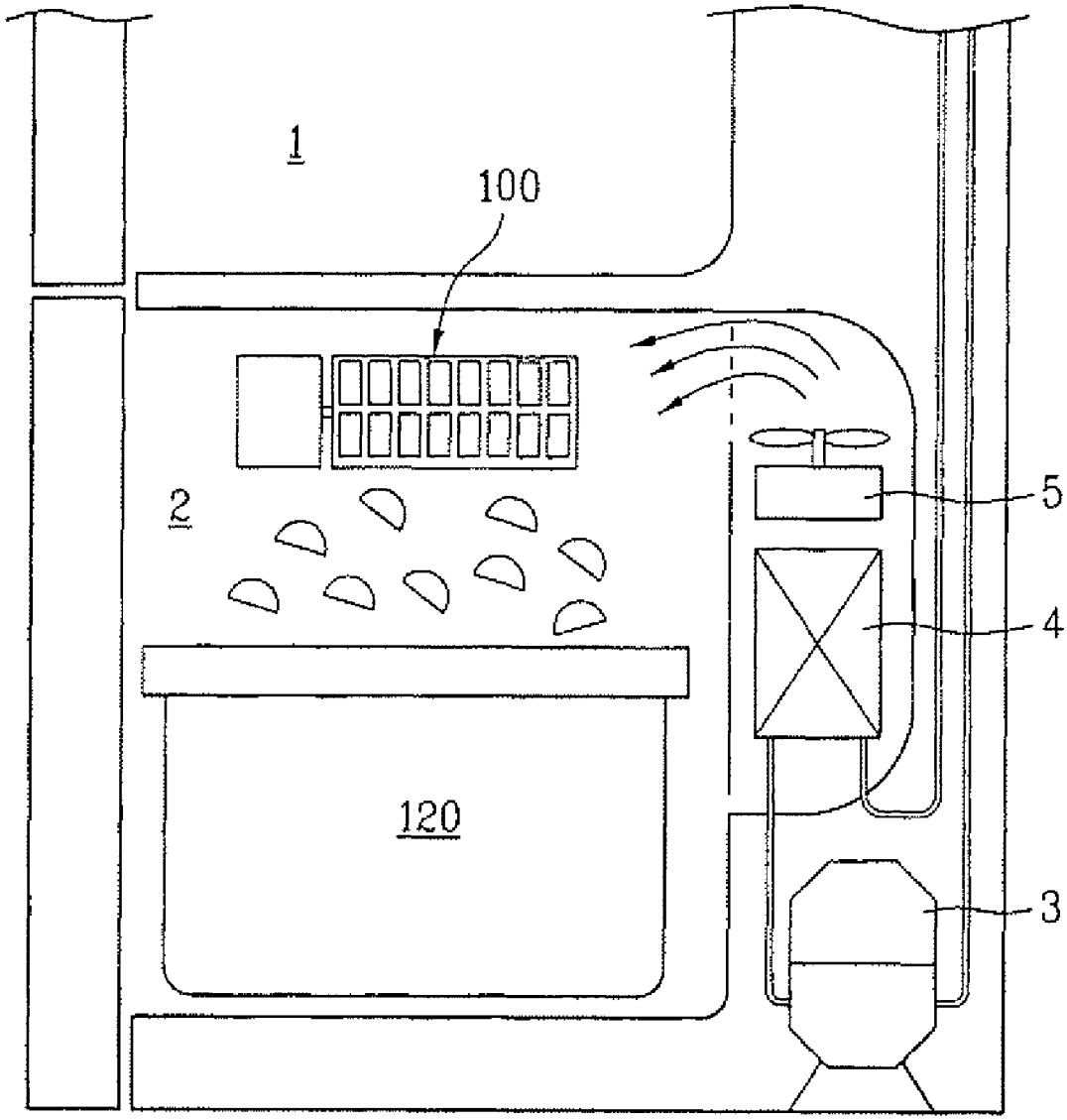
FIG. 3 is a sectional view partially illustrating a refrigerator in accordance with the present invention.

FIG. 3 illustrates a refrigerator which adapts an icemaker of the present invention. The refrigerator has at least one cooling chamber, for example, a refrigerating chamber 1 and a freezing chamber 2. The cooling chambers includes an evaporator 4, a compression 3 and a cooling fan 5 which supplies cold air near the evaporator 4 into the cooling chambers. Here, the cooling chambers may be cooled by one evaporator 4 and one cooling fan 5, or may be separately cooled by plural evaporators and cooling fans. An icemaker 100 of the present invention is provided in the freezing chamber 2 to make ice and an ice bank 120 is provided below the icemaker 100 to receive and store the ice made in the icemaker 100.

Figure 4:
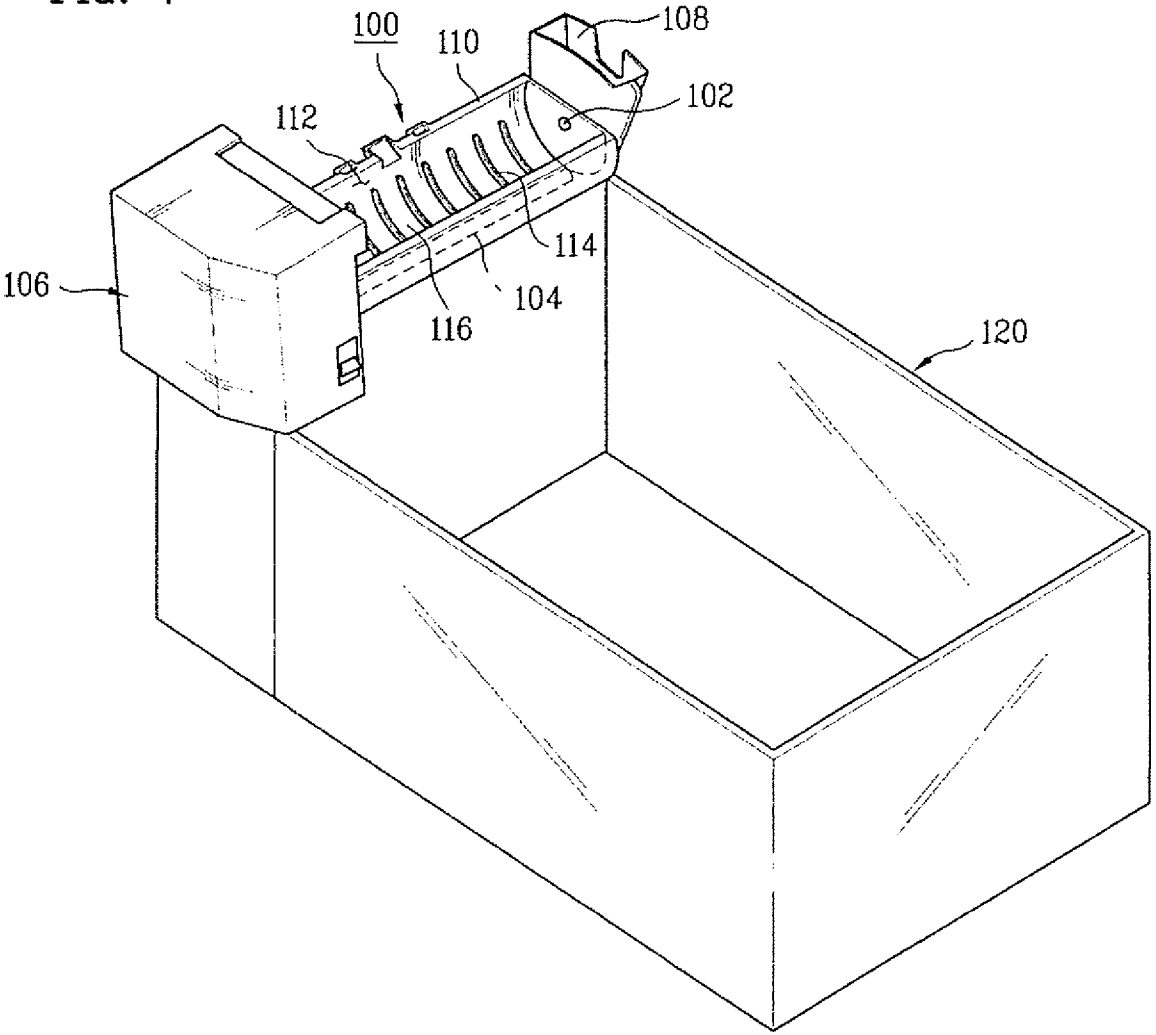
FIG. 4 is a perspective view illustrating an icemaker in accordance with a first embodiment of the present invention.
Figure 5:
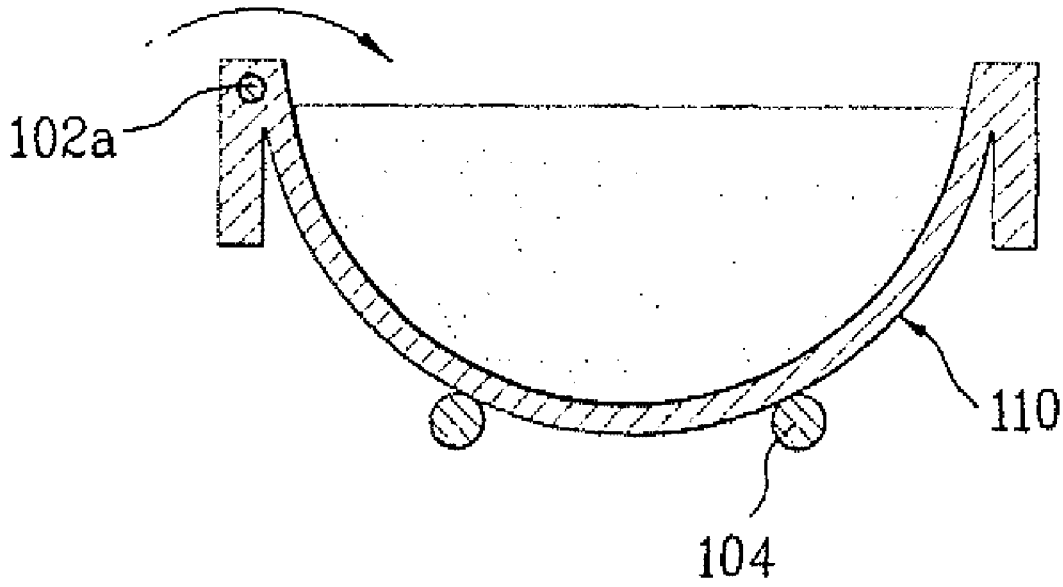
FIG. 5 is a sectional view illustrating that a rotational shaft of the icemaker in accordance with the first embodiment of present invention is provided on a side of a ice tray.

FIGS. 4 and 5 illustrate a first embodiment of the icemaker in accordance with the present invention.

In accordance with the first embodiment of the present invention, an ice tray provided in the icemaker 100 may be rotatable, unlike the conventional icemaker, to utilize the weight of ice during the ice ejecting and to reduce energy needed for separating the ice from the ice tray 110. A separation/ejecting device, which helps the ice ejected by the rotation of the ice tray 110, is provided in the icemaker 100 of the present invention. The separation/ejecting device independently or combinatively applies heat or kinetic energy to a boundary between the ice and the ice tray to efficiently help the ice ejected when the ice tray 110 rotates.

Figure 6:
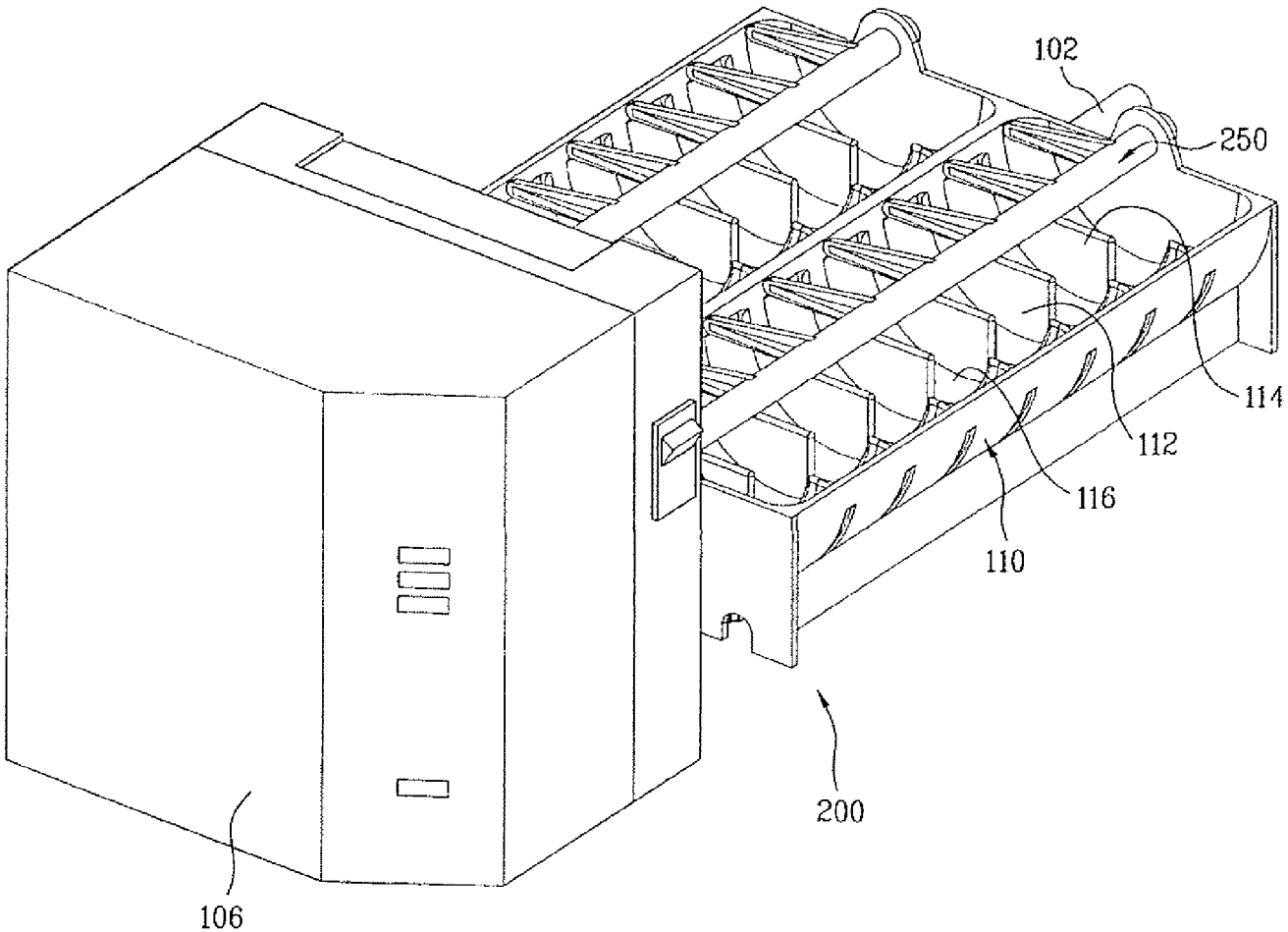
FIG. 6 is a perspective view illustrating that an ice tray has two parallel ice making chambers in an icemaker in accordance with a second embodiment of the present invention.

The ice making chamber 112 receives water to make ice. For example, the ice making chamber 112 may have a semi-cylindrical shape with an opened upper part. As shown in FIG. 4, one ice making chamber 112 may be provided in the ice tray 110 or two ice making chambers 112 may be provided in one ice tray 110 in parallel. The embodiment of the two ice making chambers 112 is shown in FIG. 6. Alternatively, the ice making chamber 112 may be provided in the ice tray 110 in plural and may have other shapes than the semi-cylindrical shape.

There are no configurations in the icemaker 100 of the present invention such as the over fill detection mechanism of the prior art which requires a large rotational radius. Thus, as shown in FIGS. 4 and 5, the width of the ice tray 110 provided in the icemaker 100 of the present invention may be larger than that of the conventional ice tray and plural ice making chambers 112 may be arranged in parallel, thereby capable of making much more ice at the same time.

The ice making chamber 112 is partitioned into plural unit chambers 116 by plural partition plates 114 projected on an inner circumferential surface of the ice tray 110, so that the ice tray 110 may make many ice pieces. The partition plate 114 is longitudinally formed along a rotational direction of the ice tray 110 to eject the ice smoothly when the ice tray 110 rotates.

The conventional icemaker 10 should have the slide 16 which guides the ice ejected by the ejector 14 into the ice bank 20 provided below the icemaker 10. However, in accordance with a first embodiment of the present invention, the icemaker 100 rotates the ice tray 110 to eject the ice of the ice tray 110 into an ice bank 120. Thus, since the ice tray 110 may not have a configuration corresponding to the slide of the prior art, the structure of the ice tray 110 can be simple.

A water supplying part 108 may be provided a side of the ice tray 110 to supply water into the ice tray 110. The water supplying part 108 is connected to an external water supply source to supply a predetermined amount of water to the ice making chamber 112 when ice making is requested under the condition of ice already being made.

As shown in FIG. 4, for example, the ice tray 110 may be rotatable with respect to a shaft 102 arranged in a center thereof. Alternatively, as shown in FIG. 5, the ice tray 110 may be rotatable with respect to a shaft 102*a* arranged in a side thereof. In the case in which the shaft 102*a* of the ice tray 110 is arranged in a side of the ice tray 110, the rotation radius of the ice tray 110 may be large.

For the rotation of the ice tray 110, an operation device 106 is provided in a portion of the ice tray 110. Operation parts (not shown) are provided in the operation device 106 and the operation parts are connected to an operation shaft (not shown) which is substantially configured to be the same shaft as the shaft 102. Also, the ice tray 110 is connected the operation shaft (not shown). The operation device 106 may rotate the ice tray 110 in a clockwise direction and a counter-clockwise direction, or continuously rotate in one of the two directions.

It is preferred that the operation parts (not shown) of the operation device 106 is rotatable in a clockwise and counter-clockwise direction to prevent the parts of the ice tray 110 and a wire connecting the part to the operation device 106 from being twisted each other. The operation device 106 may further include a step motor to rotate the ice tray 110 each predetermined angle, for example, 180 or 90 degree in a clockwise or counter-clockwise direction.

Meanwhile, the ice tray 110 may be attachable/detachable to/from the operation device 106, such that ice trays having various appearances and ice-making capacities may be selectively attachable/detachable to/from the operation device 106. Thus, user's preference can be satisfied and the amount for one ice-making can be adjusted appropriately.

Also, a separation device is installed in the ice tray 110 to separate the ice by heating. Generally, a heater 104 is adapted as separation device and the heater 104 uses heat to separate the ice from the ice tray 110.

The heater 104 may be mounted to the ice tray 110, physically contacted with the ice tray 110, or may be arranged a predetermined distance from the ice tray 110. FIGS. 4 and 5 illustrate that the heater 104 is crossing a down surface of the ice tray 110.

Although not illustrated in the drawings, the heater 104 may cover a surface of the ice tray 110, for example, a down surface. The heater 104 may be embedded in the ice tray 110 or provided in an inner surface of the ice tray 110. Alternatively, some portion of the ice tray 110 may be made of heating resistor which can radiate heat when electricity is applied to the portion.

Preferably, a temperature sensor (not shown) is installed in a portion of the ice tray 110 to sense the temperature of the ice tray 110 so that it is determined whether ice making is completed.

The operation of the icemaker in accordance with the first embodiment of the present invention will be described.

Once it is determined that the water supplied into the ice tray 110 is iced, a step of separating the ice from the ice tray 110 starts. In this embodiment, the heater 104 heats and melts a boundary between the ice tray 110 and the ice to separate the ice from the ice tray 110.

When the separation of the ice from the ice tray 110 is completed, the operation device 106 is operated to rotate the ice tray 110 with respect to the shaft 102 and the ice separated from the ice tray 110 is dropped into the ice bank 120 by its weight.

Hence, the ice tray 110 returns to its original position and prepares itself to make ice.

A second embodiment of an icemaker in accordance with the present invention will be described.

FIGS. 6 to 9 illustrate an ice tray of the icemaker in accordance with the second embodiment of the present invention.

It is preferred that configurations of an ice tray 110, an operation device 106, a heater 104 and the like provided in the icemaker of the second embodiment are the same as those of the first embodiment.

Thus, an ejector 250, which is a different configuration from the first embodiment, will be described in detail.

In accordance with the second embodiment of the present invention, it is preferred that an ejector 250 is provided in the icemaker to eject the ice made in an ice making chamber 112.

The ejector 250 will be described in more detail.

The ejector 250 of the icemaker in accordance with the second embodiment of the present invention is rotatably provided in an upper portion of the ice making chamber 112. As rotating, the ejector 250 pushes the ice made in the ice making chamber 112 to be ejected into the ice bank 120.

Preferably, the ejector 250 is formed in each ice making chamber 112 of the ice maker 100. That is, if one ice making chamber 112 is formed in the icemaker 100, the ejector 250 is rotatably provided in the ice making chamber 112. If more than two columns of the ice making chambers 112 are provided, the ejector 250 is rotatably provided in each ice making chamber 112.

Figure 7:
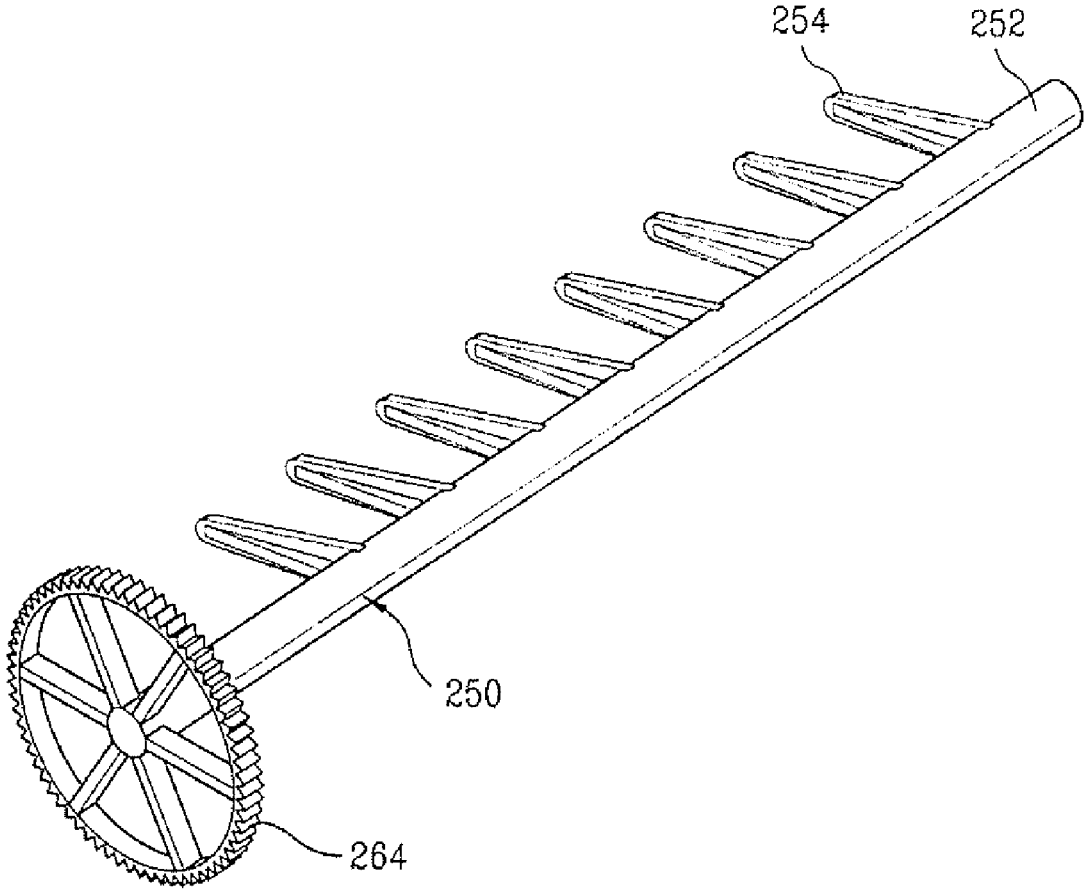
FIG. 7 is a perspective view illustrating an ejector of the icemaker in accordance with the second embodiment of the present invention.
Figure 8:
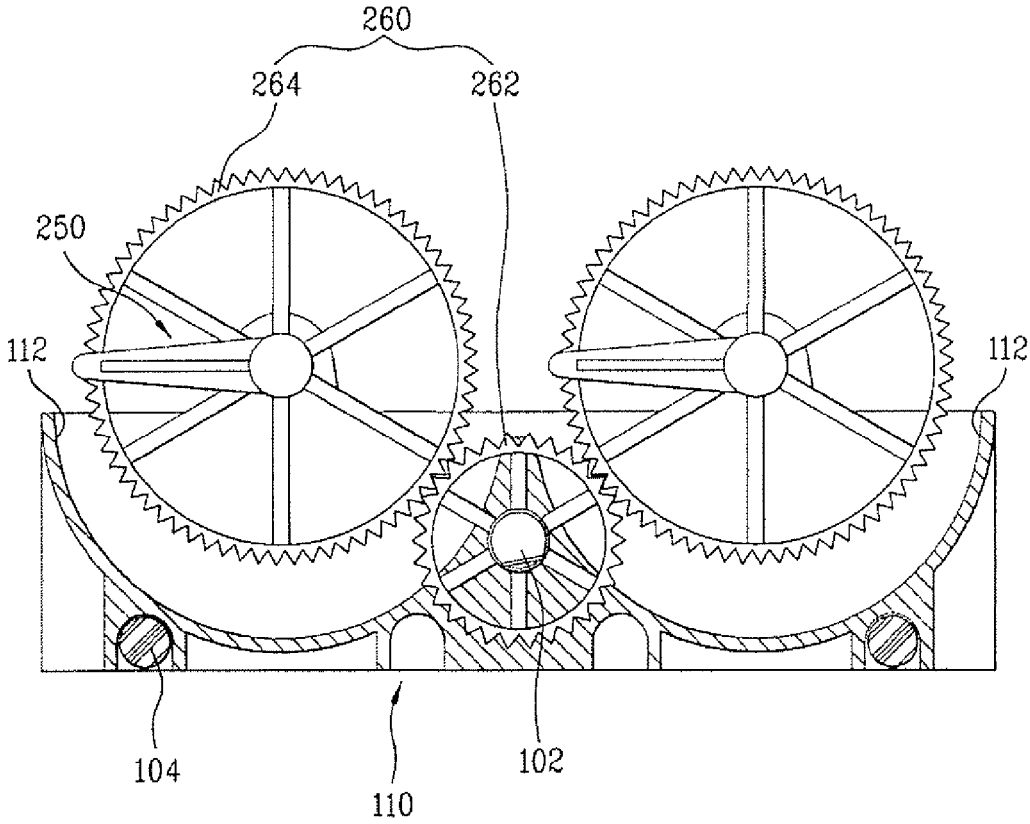
FIG. 8 is a sectional view illustrating an ice tray of the icemaker in accordance with the second embodiment of the present invention.
Figure 9:
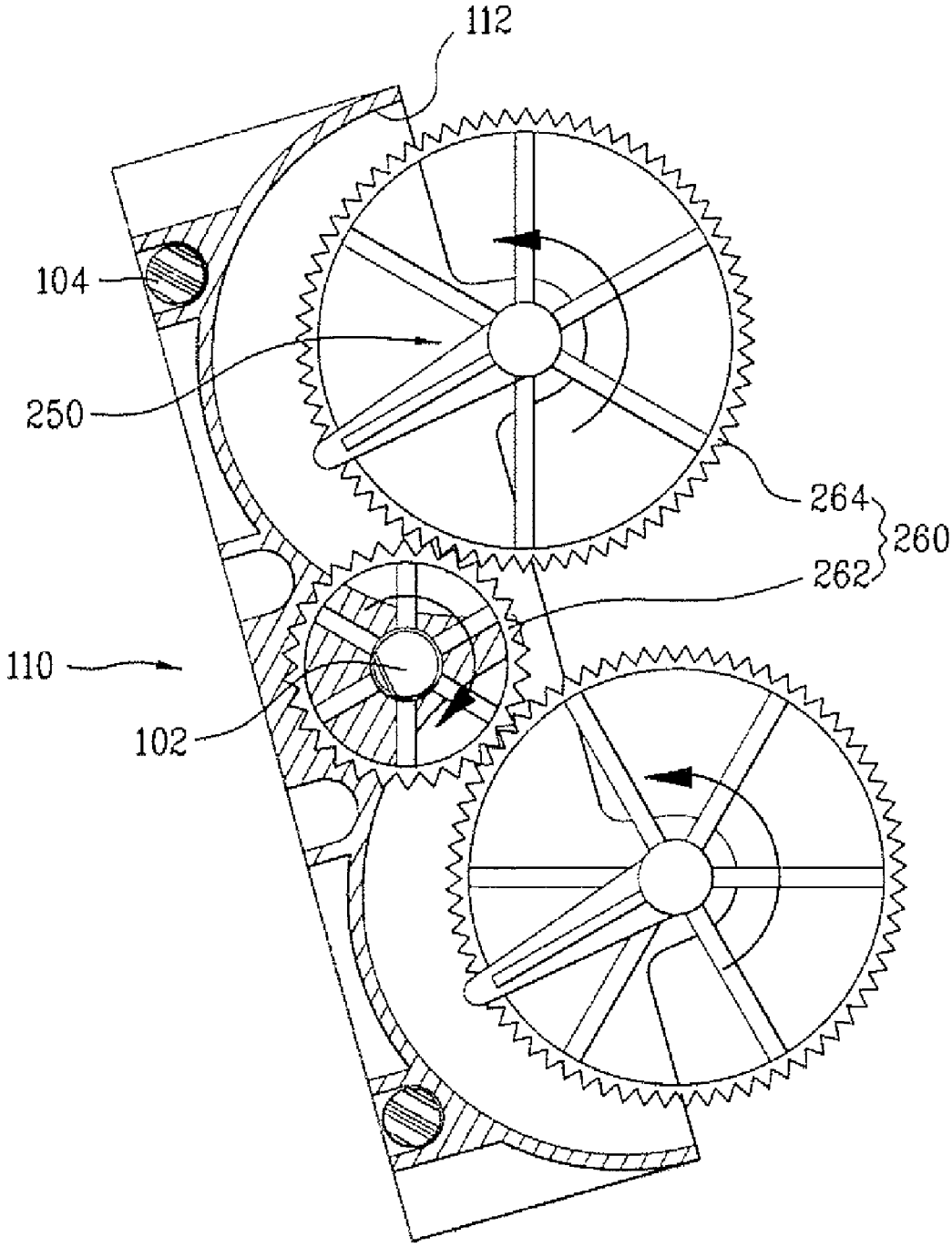
FIG. 9 is a sectional view illustrating a state where the ice tray and the ejector of FIG. 8 rotates.

FIGS. 7 to 9 illustrate the ejector 250 of the icemaker 100 in accordance with the second embodiment of the present invention.

The ejector 250 includes a shaft 252, an ejector fin 254 and an ejector operation part 260.

As shown in FIG. 6, it is preferred that both opposite ends of the shaft 252 are hingedly connected to the upper portion of the ice making chamber 112 to rotate along a longitudinal shaft of the ice making chamber 112. Also, the shaft 252 may be provided in a center of the ice making chamber 112, seen from a cross sectional view.

The ejector fin 254 is projected each predetermined distance on the shaft 252 so that the ejector fin 254 may be positioned in each unit chamber 116. Thus, the shaft 252 passes the inside of the ice making chamber 112 as rotating. Preferably, the direction of the ejector fin projection is perpendicular to the shaft 252. That is, if the ice is made within the ice making chamber 112, the ejector fin 254 pushes the ice to be moved as passing the ice making chamber 112.

Also, the ejector operation part 260 rotates the shaft 252.

In this embodiment, the ejector operation part 260 uses rotational force of the operation device 106 to rotate the shaft 252 of the ejector 250.

The ejector operation part 260 includes a driving gear 262 rotatable as the operation device 106 rotates and a driven gear 264 connected to the ejector 250 by a shaft to be engaged with the driving gear 262.

Here, the driving gear 262 may be directly connected to a driving shaft of the operation device 106 or may be engaged to the operation device 106 by a part such as a gear. In the second embodiment, the driving gear 262 is connected to the shaft 102 of the ice tray 110 to rotate as the ice tray 110 rotates and it is not limited thereto. Alternatively, the driving gear 262 may be rotated by part such as a clutch (not shown) which transmits the rotational force of the operation device 106. Thus, the driving gear 262 may be rotated by the rotational force of the operation device 106 but rotated with no relation with the rotation of the ice tray 110.

In the second embodiment, the operation device 106 rotates and the ice tray 110 rotates according to the rotational force of the operation device 106, and the driving gear 262 connected to the shaft 102 of the ice tray 110 rotates together with that. Hence, the driven gear 264 engaged to the driving gear 262 rotates to rotate the shaft 252 and the ejector fin 254.

As the ejector fin 254 rotates to press the ice aside, the ice is sliding along a wall of the ice making chamber 112 and ejected out of the ice making chamber 112.

Next, a third embodiment of the ice maker in accordance with the present invention will be described.

Figure 10:
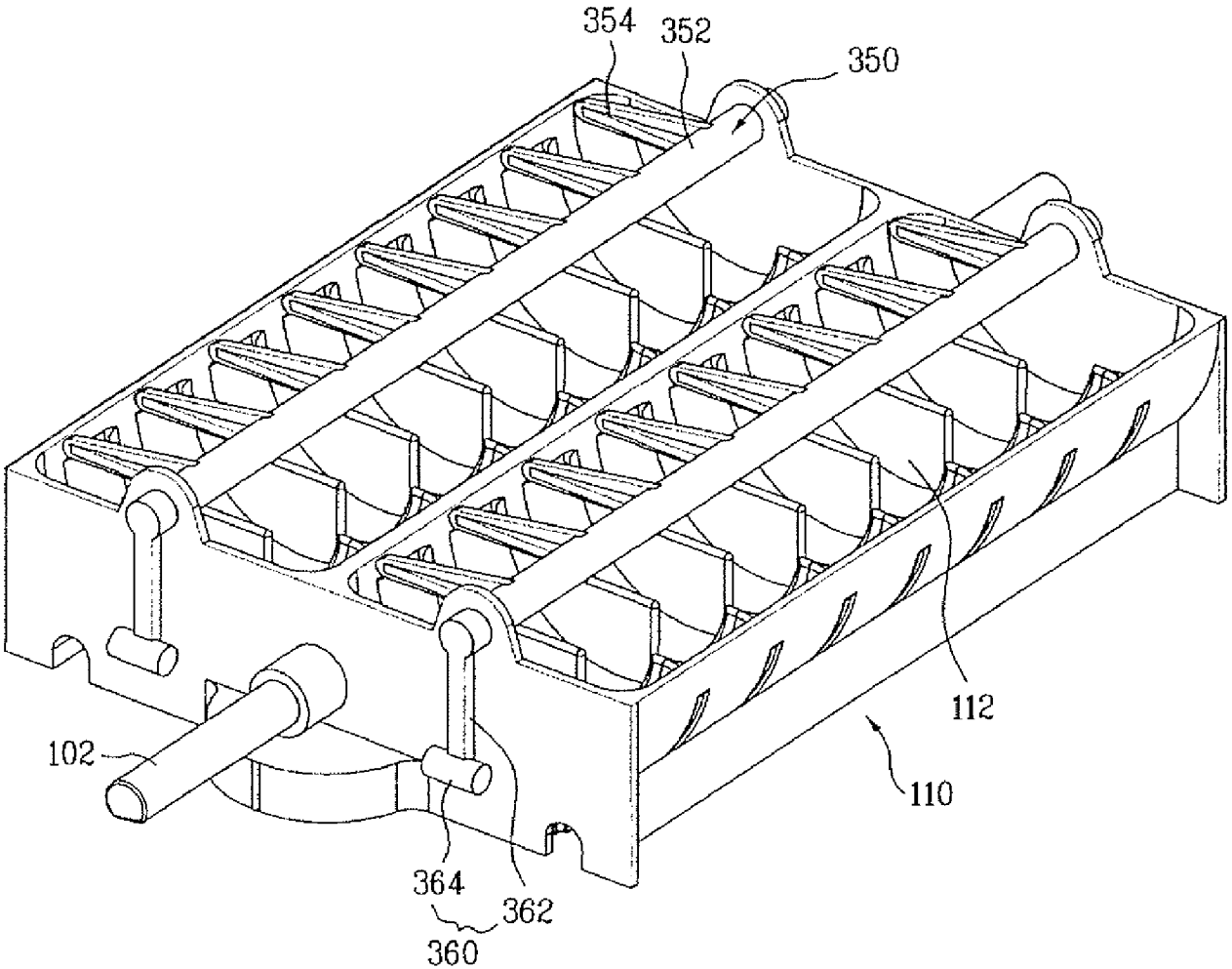
FIG. 10 is a perspective view illustrating an ice tray of an icemaker in accordance with a third embodiment of the present invention.

FIG. 10 illustrates an ice tray of the icemaker in accordance with the third embodiment of the present invention.

It is preferred that configurations of an ice tray 110, an operation device 106, a heater 104 and the like provided in the icemaker of the third embodiment are the same as those of the first and second embodiment.

Thus, an ejector 350, which is a different configuration from the first and second embodiment, will be described in detail.

It is preferred that the ejector 350, like the first and second embodiment, is provided in each ice making chamber 112 of the ice maker 100. That is, if one ice making chamber 112 is formed in the icemaker 100, the ejector 350 is rotatably provided in one ice making chamber 112. If more than two columns of ice making chambers 112 are provided, the ejector 350 is rotatably provided in each ice making chamber 112.

Figure 11:
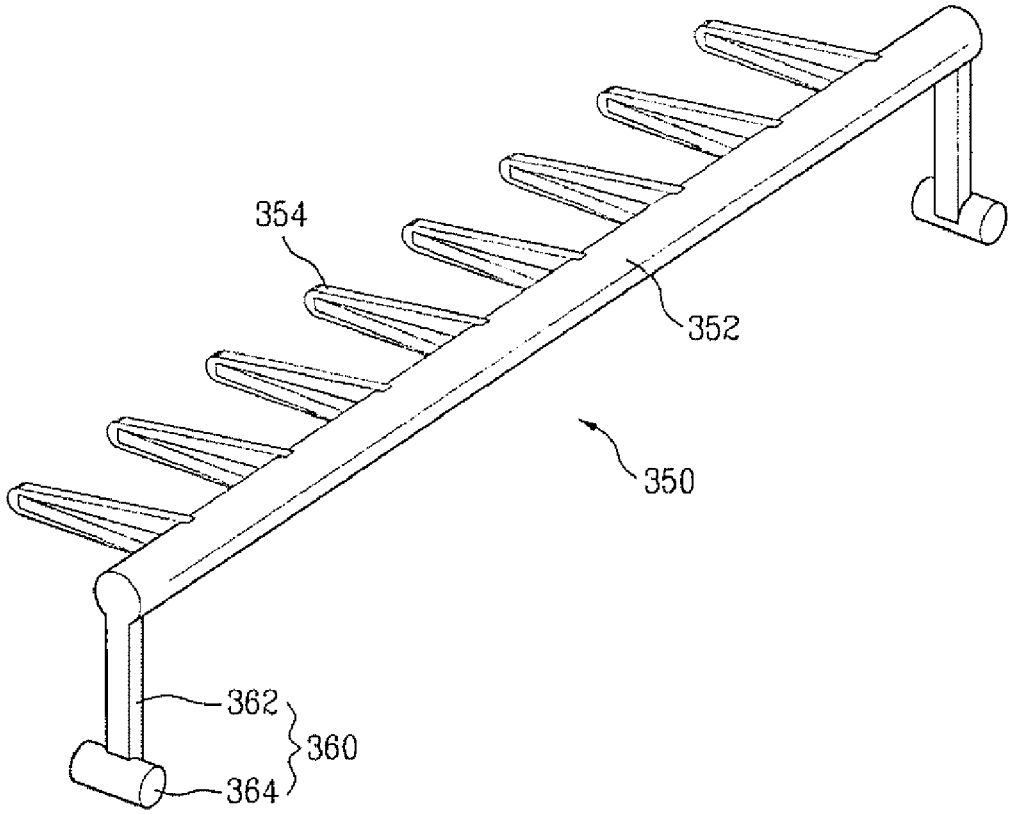
FIG. 11 is a perspective view illustrating an ejector of the icemaker in accordance with the third embodiment of the present invention.

FIG. 11 illustrates the ejector 350 of the icemaker in accordance with the third embodiment of the present invention.

The ejector 350 includes a shaft 352, an ejector fin 354 and an inertial operation part 360.

The shaft 352 and the ejector fin 354 have the same appearances and functions as those of the second embodiment, thereby detailed description being omitted.

The inertial operation part 360 having heavy weight is apart a predetermined distance from a center of the shaft 352 to generate rotational force by its weight when the ice tray 110 rotates, such that the shaft 352 may relative-rotate the shaft 352 with respect to the ice tray 110.

The inertial operation part 360 includes a weight 362, and an arm 364 having an end connected to an end of the shaft 352 and the other end connected to the weight 362.

Here, the heavier the weight 362 is, the more efficiently is the ice elected. But, that is variable according to the capacity and the size of the product and well-known to anyone skilled in the art. Thereby, the specific weight of the weight 362 is not limited in this embodiment.

The arm 364 positions the weight 362 spaced apart from the center of the shaft 352. The longer the arm 364 is, the greater is the rotational force applied to the shaft 352 of the ejector 350. But, that is variable according to the capacity and size of the product and anyone skilled in the art may easily calculate the optimal length of the arm 364, thereby the length of the art not being limited in this embodiment.

The inertial operation part 360 may be formed only in an end of the shaft 352 or formed in each opposite end of the shaft 352.

Figure 12:
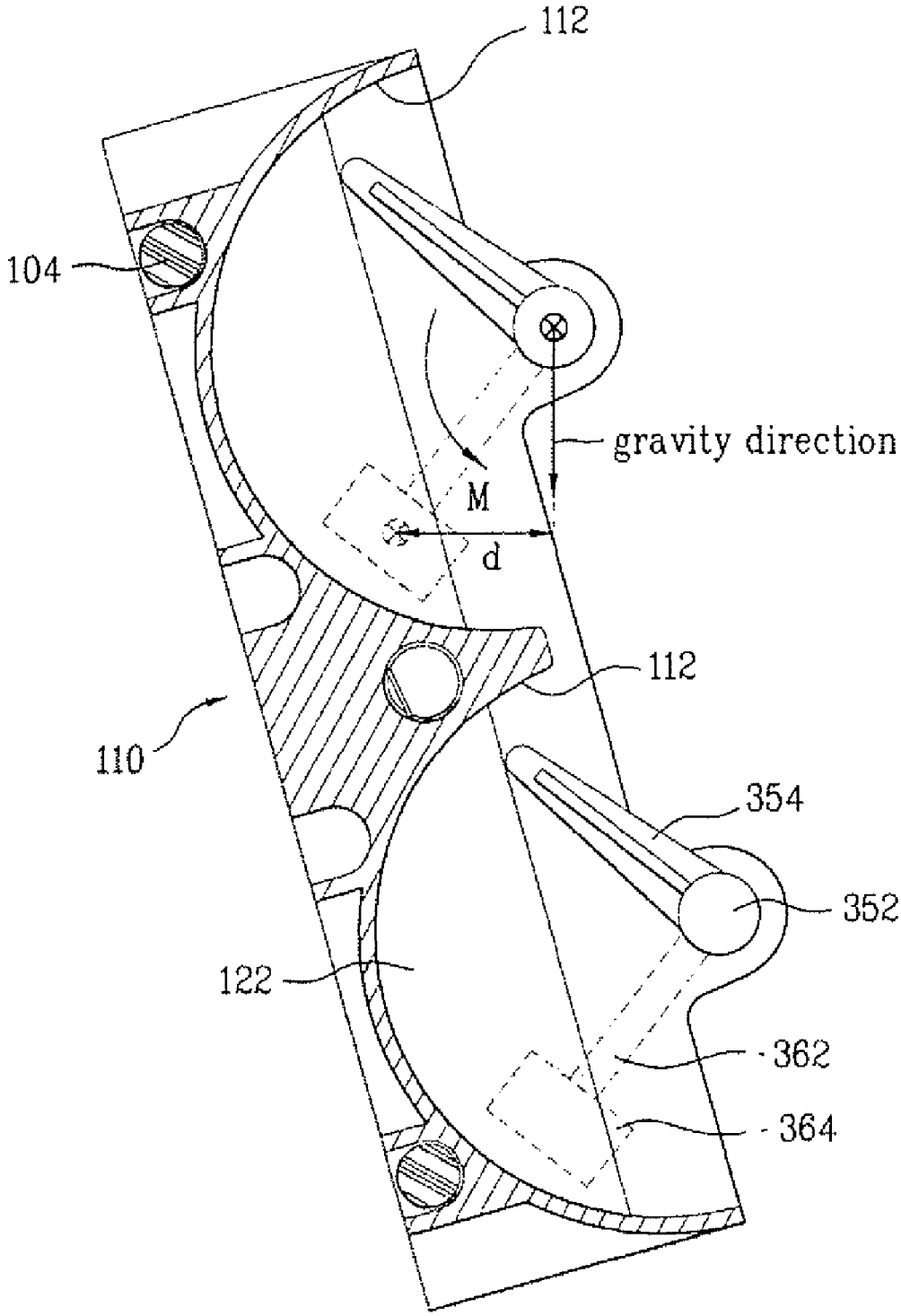
FIG. 12 is a sectional view illustrating a state where an ice tray of the icemaker rotates in accordance with the third embodiment of the present invention.

FIG. 12 illustrates a state where the ice tray of the icemaker rotates in accordance with the second embodiment of the present invention.

Once the ice tray 110 rotates, the arm 364 and the weight 362 of the ejector 350 are always toward gravity direction and a force rotating the ejector 350 is generated.

That is, if the ice tray 110 rotates with the ice being within the ice making chamber 112, the ejector fin 354 is supported by the ice not to rotate the shaft 352. Thus, the weight 362 is getting apart toward a side from a center of the shaft 352.

Figure 13:
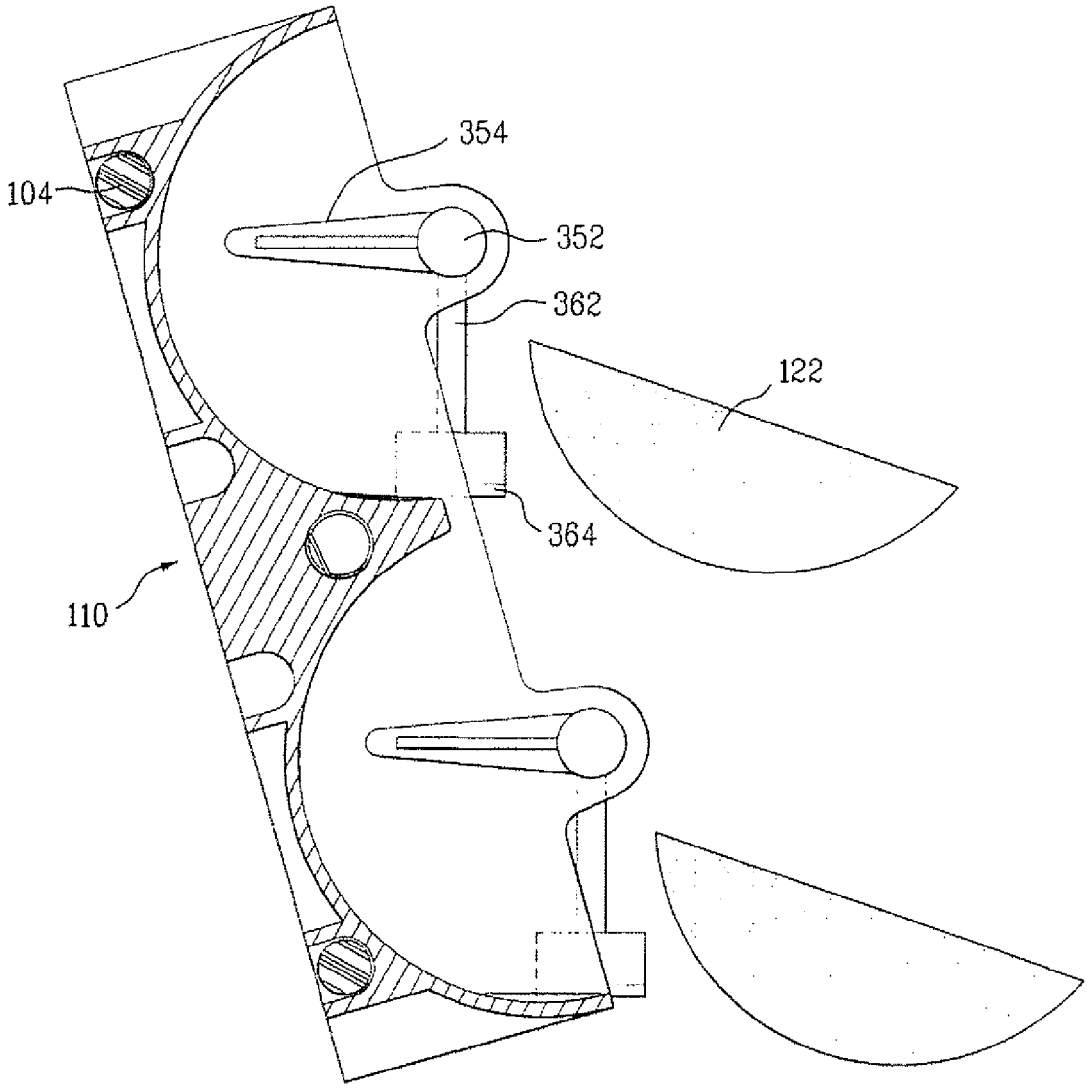
FIG. 13 is a sectional view illustrating that an ejector rotates in the state of FIG. 12.
Figure 14:
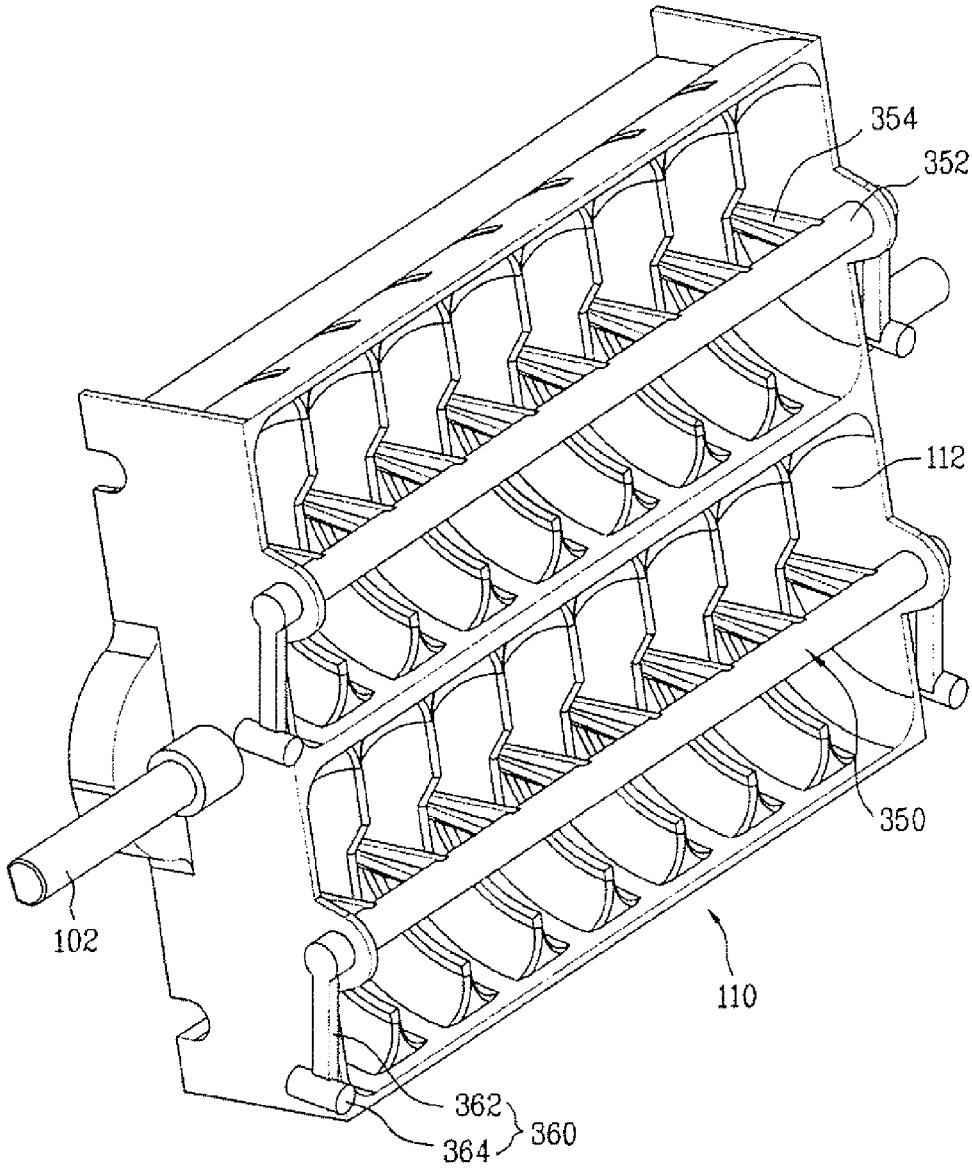
FIG. 14 is a perspective view illustrating that the ice tray and the ejector rotate in accordance with the third embodiment of the present invention.

FIGS. 13 and 14 illustrate a state where an ice tray and an ejector of the icemaker rotated in accordance with the third embodiment of the present invention.

The rotational force (M) is generated which rotates the ejector 350 due to the mass of the weight 362 and the distance from the weight 362 to the center of the shaft 352, and the ejector fin 354 applies the force which presses the ice aside to push the ice. Hence, the ice is moved and ejected to the ice bank 120.

Also, a sensor (not shown) is further included in this embodiment to sense whether the ice 122 is ejected. Preferably, the sensor (not shown) is a sensor which senses whether the ejector 350 rotates.

That is, it is not limited to a sensor which senses the rotation of the ejector 350 and alternatively the sensor (not shown) may sense the ice ejecting in various ways.

As mentioned before, the configurations not described in this third embodiment are the same as those of the first and second embodiment.

Next, a fourth embodiment of the icemaker in accordance with the present invention will be described.

Figure 15:
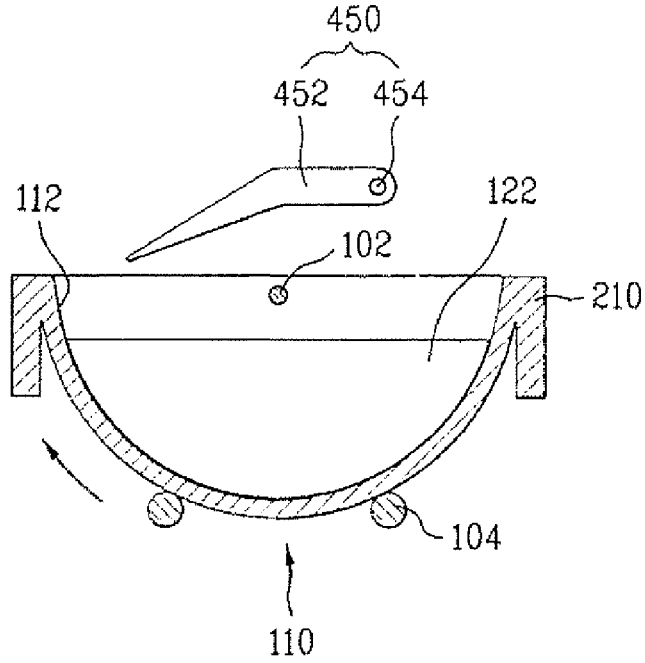
FIG. 15 is a sectional view illustrating an ice tray of an icemaker in accordance with a fourth embodiment of the present invention.

FIG. 15 illustrates a sectional view of an ice tray in accordance with the fourth embodiment of the present invention.

It is preferred that configurations of an ice tray 110, an operation device 106, a heater 104 and the like provided in the icemaker of the fourth embodiment are the same as those of the first, second and third embodiment.

Thus, an ejector 450, which is a different configuration from the first, second and third embodiment, will be described in detail.

It is preferred that the ejector 450, like in the first, second and third embodiment, is formed each ice making chamber 112. That is, if one ice making chamber 112 is formed in the icemaker 100, the ejector 450 is provided over the one ice making chamber 112. If more than two columns of the ice making chambers 112 are formed in the icemaker 100, the ejector 450 is provided over each ice making chamber 112.

The ejector 450 includes a shaft 452 and an ejector fin 454.

The biggest difference between the ejector 450 of the fourth embodiment and the ejectors of the former embodiments is that the ejector 450 is fixed, spaced apart from the ice tray 110, unlike the ejectors of the former embodiments rotatably provided in the ice tray 110.

Thus, the shaft 452 of the ejector 450 is not provided in the ice tray 110. Although not described in the drawings, it is preferred that the ejector 450 is spaced a predetermined distance from an upper portion of each ice making chamber 112 by a supporting part (not shown) supporting a non-rotational part.

As mentioned before, the shaft 452 is fixed not to rotate as the ice tray 110 rotates.

The ejector fin 454 is projected on the shaft 452 along each predetermined distance. Also, it is preferred that the ejector fin 454 is going inside of the ice making chamber 112 as the ice tray rotates 110.

Figure 16:
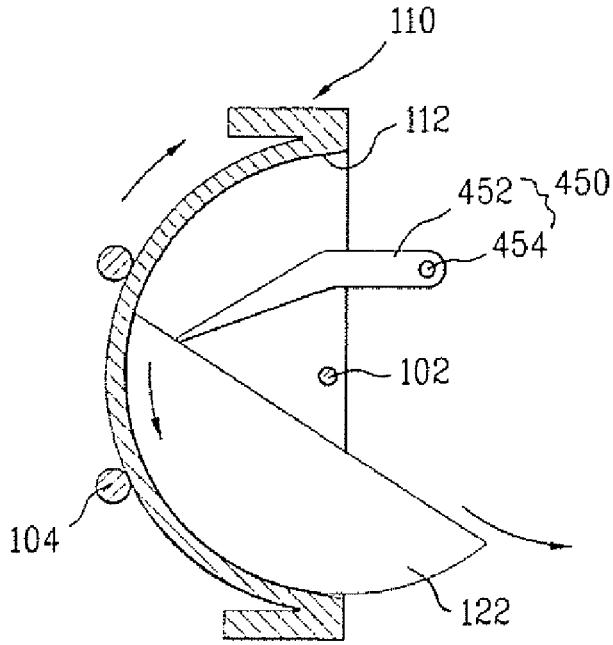
FIG. 16 is a sectional view illustrating a state where the ice tray of FIG. 15 rotates.

FIG. 16 illustrates a state where the ice tray of the icemaker rotates in accordance with the fourth embodiment of the present invention.

As shown in FIG. 16, the ejector fin 454 presses the ice 122 of the ice making chamber 112 to be pushed out of the ice making chamber 112.

The ice tray 110 adapted in the first and fourth embodiments of the present invention may rotate less than 90 degree from its original horizontal condition. If the ice tray 110 rotates less than 90 degree, there is an effect that the water generated in melting the boundary between the ice and the ice making chamber 112 may not be dropped in the ice tray 110 but remain within the ice making chamber 112.

Also, although the ice tray 110 rotates less than 90°, the ejector 150 helps the ice ejected outside. Thereby, there is no disadvantage in the ice ejecting.

Next, a method for controlling the icemaker of the embodiments will be described.

First of all, a first embodiment of the method will be described.

The first embodiment of the method includes making ice S110, determining whether ice making is completed S120, separating the ice from the ice making chamber S130, ejecting the ice S140 and returning the ice tray to its original position S150.

In the step S110 of making ice, ice is made in the ice making chamber 112 of the ice tray 110. After the step S110, the step S120 of determining whether ice making is completed starts.

In the step S120, it is determined whether the ice 122 is completely made in the ice making chamber 112. Generally, it is determined that the ice making is completed if the temperature of the ice tray 110 is below a predetermined temperature and this embodiment is not limited thereto.

If it is determined that ice making is completed, the step S130 of separating the ice from the ice making chamber 112 starts.

Commonly, the ice made in the ice making chamber 112 is stuck on a wall of the ice making chamber 112. In the step S130 of separating the ice from the ice making chamber 112, the ice stuck on the wall of the ice making chamber 112 is separated.

It is general that the heater 104 heats the ice to be separated from the ice making chamber 112 and melts a portion where the ice is stuck, but it is not limited thereto. Other ways of using physical force to separate the ice are possible.

The ice 122 may be completely separated from the ice making chamber 112 in the step S130 and alternatively some portion of the ice may be separated, which will be described later.

Once the step S130 is completed, a step S140 of ejecting the ice out of the ice making chamber 112 starts.

In the step S140, the ice 122 of the ice making chamber 112 is ejected outside.

Preferably, the ejected ice 122 is moved to the ice bank 120.

The step S140 of ejecting the ice out of the ice making chamber 112 may be a step of rotating the ice tray 110 and the ejector 250 and 350.

Meanwhile, the step S140 of ejecting the ice out of the ice making chamber 112 may be a step of rotating only the ice tray 110 in the icemaker where the ejector 250 and 350 is not rotated but fixed.

Once the step S140 is completed, a step S150 of returning the ice tray 110 and the ejector 250 and 350 to their original positions starts. Preferably, after the step S150, the step S110 of making ice in the ice making chamber 112 re-starts.

The step S130 of separating the ice from the ice making chamber 112 will be described in detail.

It is embodied that the heater 104 is adapted as a separation part which separates the ice from the ice making chamber 112. Here, the operation time of the heater 104 will be described.

Generally, the more ice 122 is melted, the weaker the adhesive force of the ice which tends to be stuck to a wall of the ice making chamber 112.

Preferably, the heater 104 is operated until adhesive force which acts between the ice 122 and the ice tray 110 is less than pushing force in which the ejector 250 and 350 pushes the ice 122.

Thus, as the heater 104 is operated, some boundary between the ice and the wall of the ice making chamber 112 is melted to weaken the adhesive force of the ice 122. Furthermore, as the ice tray 110 rotates, the ice 122 tends to be dropped by its weight and the ejector fin 254 and 354 pushes the ice 122.

Thus, although the boundary between the ice 122 and the wall of the ice making chamber 112 is not melted completely, the force applied by the ejector 250 and 350 separates the ice from the other boundary portion of the wall which has not been melted yet.

In case that the heater 104 heats the ice tray 110, the ice tray 110 is heated slowly to melt a boundary portion between the ice and the wall of the ice making chamber 112 and other portions which are distant from the heater 104 are melted slowly and less. Thus, over melting of a partial boundary portion may not be prevented completely.

Thereby, to prevent the ice 122 from being melted too much, it is preferred to control a way and the time of supplying heat energy appropriately.

For that, the present invention presents that high energy is applied to a boundary portion between the ice and the ice tray 110 for a short time. For example, if a high voltage is momentarily applied to the heater 104 which heats the ice tray 110, the heater 104 radiates high temperature heat momentarily and heat the ice tray 110 with the high temperature heat so that at least some portion of the boundary between the ice 122 and the ice tray 110 may be melted. Here, if the ice tray 110 rotates or is already rotated, the ice 122 is separated from the ice tray 110 by its weight or the force of the ejector 250 and 350 before the partial boundary portion is too much melted.

Thus, it is efficiently prevented that water is dropped by over-melted ice when the ice tray 110 rotates. It is efficiently reduced that electricity is wasted by heating the ice tray 110 too much.

Meanwhile, the force which acts downwardly due to the weight of the ice is varied by a rotational angle of the ice tray 110 and the pushing force where the ejector 150 pushes the ice is varied by the rotational force of the operation device 106. The way of evaluating the values is well-known to anyone skilled in the art, thereby being omitted in the description of the present invention.

When the operation time of the heater is controlled, the water melted from the ice may be minimized and electricity usage may be reduced, compared with a method of melting all portions of the ice stuck to the wall of the ice making chamber 112.

Moreover, it is preferred in this embodiment that the time for the operation of the heater 104 is predetermined in a controlling part.

Figure 17:
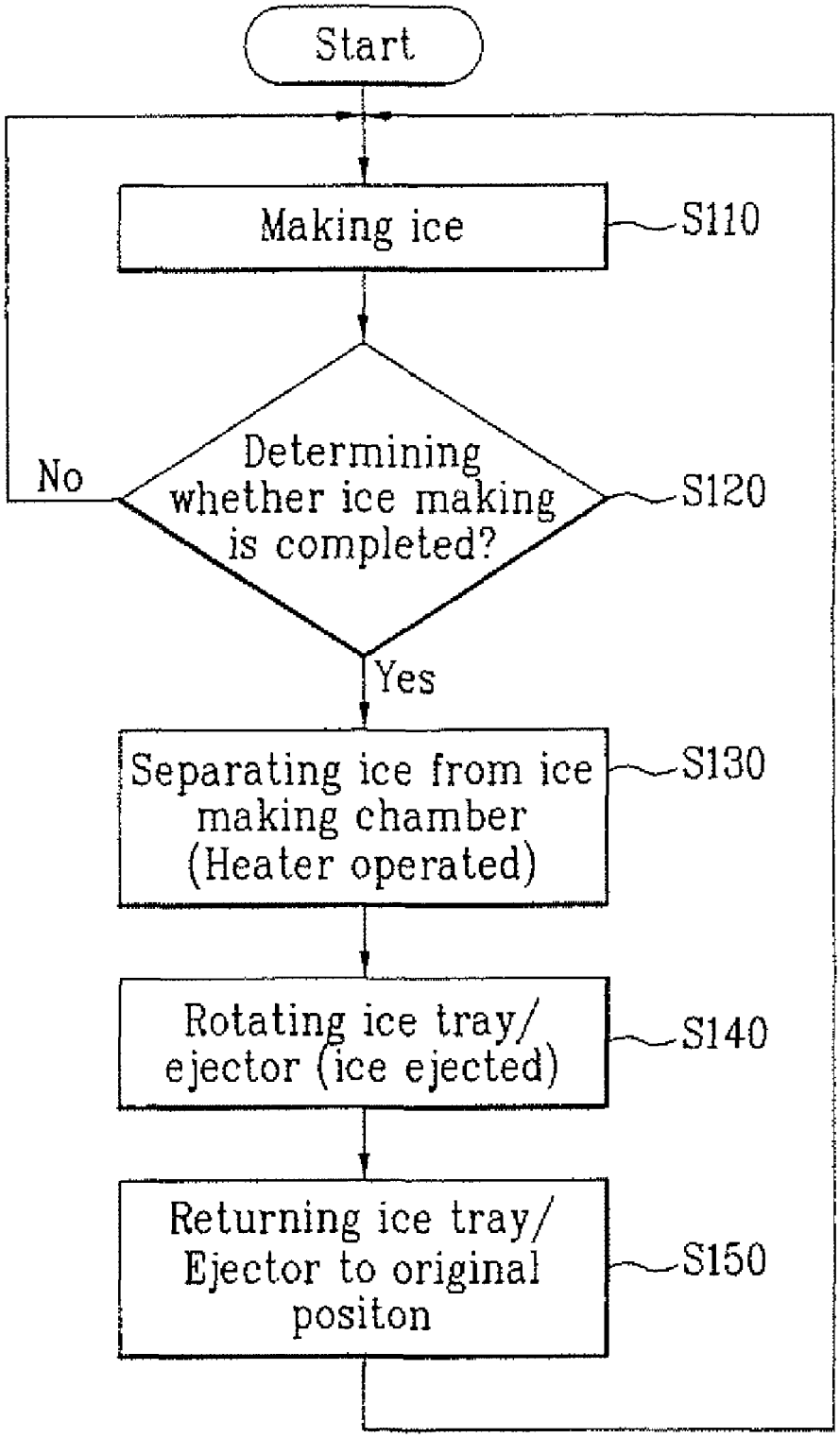
FIG. 17 is a flow chart showing a first embodiment of a method for controlling an icemaker in accordance with the present invention.
Figure 18:
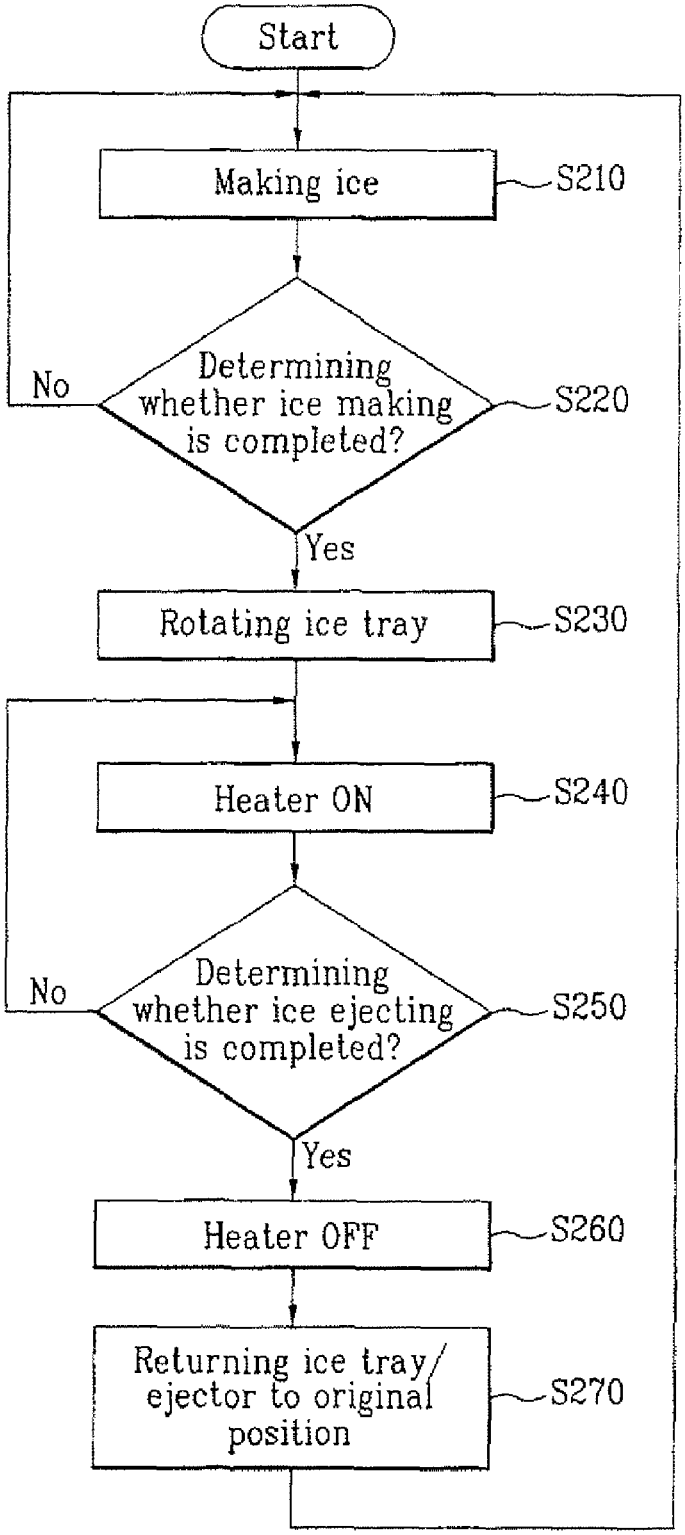
FIG. 18 is a flow chart showing a second embodiment of the method for controlling an icemaker in accordance with the present invention.

FIG. 17 illustrates a flow chart of a method for controlling the icemaker in accordance with a second embodiment.

The method for controlling the icemaker in accordance with the second embodiment includes a step S210 of ice making, a step S220 of determining whether the ice making is completed, a step S230 of rotating the ice tray 110, a step S240 of separating the ice from the ice making chamber 112 and ejecting the separated ice out of the ice making chamber 112, a step S250 of determining whether the ejecting of the ice is completed and a step S270 of returning the ice tray 110 and the ejector 250 to their original positions.

The step S210 of ice making and the step S220 determining whether the ice making is completed are the same as those of the first embodiment and will be omitted.

Preferably, once it is determined whether ice making is completed, the step S230 of rotating the ice tray 110 starts.

In the step of S230, the ice tray 110 rotates. Once the rotation of the ice tray 110 is completed, the step S240 of separating the ice from the ice making chamber 112 and ejecting the separated ice out of the ice making chamber 112 starts.

In the step S240, the ice 122 stuck to a wall of the ice making chamber 112 is separated and the separated ice is ejected out of the ice making chamber 112.

The step S240 will be described in detail as follows.

Generally, the way is adapted to separate the ice from the ice making chamber 112, in which the heater hear the ice 122 to melt an outer surface of the ice 122 stuck to the ice making chamber 112.

In case of the third embodiment of the icemaker, as shown in FIG. 12, the ejector fin 354 is pushing the ice 122 due to the inertial operation part 360 as the ice tray 110 is rotates in the step S230. Also, the force generated by the weight of the ice which drops the ice 122 may be acting based on a rotational angle of the ice tray 110.

Thus, if the heater 104 is operated to melt the ice 122 in that condition, the ice is separated at the moment that the adhesive force of the ice 122 is less than the force pushed by the ejector 350 and the force acting due to the weight of the ice 122.

The separated ice 122 is continuously pushed by the ejector fin 354 to be ejected out of the ice making chamber 112.

Thereby, separation and ejection of the ice 122 can be made at the same time.

After the step S240, a step S250 of determining whether the ejecting of the ice 122 is completed starts.

In the step S250, whether the ejecting of the ice 122 is completed may be determined by whether the ejector 250 rotates.

More, specifically, if the ejector 250 rotates, it is determined that the ejecting of the ice 122 is completed. If the ejector 250 does not rotate, it is determined that the ejecting of the ice 122 is not completed.

It is preferred that a sensor (not shown) is provided to sense whether the ejector 250 rotates.

Alternatively, in the step S250, whether the ejecting of the ice 122 is completed may be determined by whether the ejector 250 rotates in a predetermined angle.

Once it is determined that the ejecting of the ice 122 is completed, the heater 104 operated in the step S240 is stopped.

Thus, the heater 104 is operated until the adhesive force of the ice 122 stuck to the wall of the ice making chamber 112 is less than the force which is generated by the weight of the ice 122 and acts downwardly and the force applied to the ice by being pushed by the ejector 250.

Since the operation time of the heater 104 is optimally controlled, water melted from the ice 122 may be minimized. Also, compared with the method of melting all portions of the ice 122 stuck to the wall of the ice making chamber 112, electricity usage of the heater 104 may be reduced and the operation time of the heater 104 may not be additionally predetermined.

Moreover, after the operation of the heater 104 is stopped, the step S270 of returning the ice tray 110 and the ejector 350 to their original positions is performed. After the step S270, it is preferred that the step S210 of making ice starts.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As described before, the icemaker and the method for controlling the same in accordance with the present invention has following advantageous effects.

First, in the conventional structure of the icemaker, a space should be spared in a portion of the icemaker to eject ice. However, since the ice is ejected in a space secured during the rotation of the ice tray, the structure of present invention has an advantageous effect that the space making ice may be enlarged.

Second, since the present invention can use the force generated by the weight of the ice and the force generated by the ejector pushing the ice to eject the ice, the present invention has another advantageous effect that the operation time of the heater may be reduced to cause energy saving.

Finally, since the operation time of the heater is shortened, the present invention has a still another advantageous effect that the amount of ice melted by the heater may be minimized. Also, dropping water may be minimized.

What is claimed is:

1. An icemaker comprising:

a rotatable ice tray with at least one column of ice making chambers formed therein to make ice;

an ejector rotatably provided in each ice making chamber to eject the ice formed in the ice making chamber;

an operation device which rotates the ice tray; and a separation device which separates the ice from the ice tray;

wherein the ejector includes:

a shaft rotatable along a longitudinal direction of the ice tray;

at least one ejector fin projected on the shaft at a predetermined distance to eject the ice of the ice tray as the shaft rotates; and an inertial operation part which generates rotational force due to its weight when the ice tray rotates, to relatively rotate the shaft with respect to the ice tray, the inertial operation part having a weight and an arm having an end connected to an end of the shaft and the other end connected to the weight.

2. The icemaker of claim 1, wherein the separation device is a heater which heats the ice.

3. The icemaker of claim 2, wherein the heater is operated until adhesive force which acts between the ice and the ice tray is smaller than pushing force in which the ejector pushes the ice.

4. The icemaker of claim 2, wherein the heater applies high energy to a boundary portion between the ice and the ice tray to melt at least some boundary portion where the ice is stuck to the ice tray, so that the ice is prevented from being melted enough to drop water when the ice tray rotates.

5. The icemaker of claim 1, wherein the ejector further comprises, an ejector operation part which rotates the ejector by using rotation force of the operation device.

6. The icemaker of claim 5, wherein the ejector operation part comprises, a driving gear which rotates according to the rotation of the operation device; and a driven gear provided in the ejector to be engaged to the driving gear.

7. The icemaker of claim 1, wherein the ejector further comprises a sensor which senses whether the ejector rotates.

8. An icemaker comprising:

a rotatable ice tray with at least one column of ice making chambers formed therein to make ice;

an ejector rotatably provided in the ice tray to eject the ice made in the ice making chamber;

an operation device which rotates the ice tray; and a separation device which separates the ice from the ice tray;

wherein the ejector includes:

a shaft rotatable along a longitudinal direction of the ice tray;

at least one ejector fin projected on the shaft at a predetermined distance to eject the ice of the ice tray as the shaft rotates; and an inertial operation part which generates rotational force due to its weight when the ice tray rotates, to relatively rotate the shaft with respect to the ice tray, the inertial operation part having a weight and an arm having an end connected to an end of the shaft and the other end connected to the weight.

9. The icemaker of claim 8, wherein the separation device is a heater which heats the ice.

10. The icemaker of claim 9, wherein the heater is operated until adhesive force which acts between the ice and the ice tray is smaller than pushing force in which the ejector pushes the ice.

11. The icemaker of claim 9, wherein the heater applies high energy to a boundary portion between the ice and the ice tray to melt at least some boundary portion where the ice is stuck to the ice tray, so that the ice is prevented from being melted enough to drop water when the ice tray rotates.

* * * * *